US006829784B2

(12) United States Patent
Austin

(10) Patent No.: US 6,829,784 B2
(45) Date of Patent: Dec. 14, 2004

(54) FIREFIGHTING HOOD WITH DUAL BIB

(75) Inventor: Rick A. Austin, Shawnee, OK (US)

(73) Assignee: Tayco, Shawnee, OK (US)

( * ) Notice: Subject to any disclaimer, the term of this patent is extended or adjusted under 35 U.S.C. 154(b) by 211 days.

(21) Appl. No.: 10/223,746

(22) Filed: Aug. 19, 2002

(65) Prior Publication Data

US 2003/0033657 A1 Feb. 20, 2003

Related U.S. Application Data

(60) Provisional application No. 60/313,254, filed on Aug. 17, 2001.

(51) Int. Cl.[7] ..... A42B 1/00
(52) U.S. Cl. ..... 2/7; 2/81; 2/202
(58) Field of Search ..... 2/5, 7, 8, 410, 2/202, 203, 205, 84, 171, 423, 458, 459, 461, 468

(56) References Cited

U.S. PATENT DOCUMENTS

| | | | | |
|---|---|---|---|---|
| 3,943,571 A | | 3/1976 | Boatman | 2/2.1 |
| 4,573,217 A | * | 3/1986 | Reed | 2/7 |
| 5,090,054 A | * | 2/1992 | Grilliot et al. | 2/5 |
| 5,109,549 A | * | 5/1992 | Mattinson | 2/202 |
| 5,181,506 A | | 1/1993 | Tardiff, Jr. et al. | 128/201.22 |
| 5,251,336 A | | 10/1993 | Nevins | |
| 5,625,902 A | * | 5/1997 | Drews et al. | 2/205 |
| 5,628,065 A | * | 5/1997 | Austin | 2/81 |
| 5,653,225 A | | 8/1997 | Schegerin | 128/201.24 |
| 6,006,360 A | | 12/1999 | Reed | 2/202 |
| 6,023,787 A | * | 2/2000 | French et al. | 2/202 |
| 6,088,838 A | * | 7/2000 | Sontag | 2/202 |
| 6,260,207 B1 | * | 7/2001 | Barbeau et al. | 2/202 |

OTHER PUBLICATIONS

Steven B. Warner, Fiber Science, 1995, Prentice–Hall, pp. 130–139.*

* cited by examiner

*Primary Examiner*—Gary L. Welch

(57) ABSTRACT

A firefighting hood for protecting an individual from elements associated with a firefighting site. The firefighting hood includes a head portion, an inner bib portion, and an outer bib portion. The head portion is shaped to cover the individual's head, the inner bib portion extends downwardly from the head portion and is shaped to cover the individual's neck and a portion of the individual's torso, and the outer bib portion extends downwardly from the head portion and overlaps the inner bib portion such that the inner bib portion is positionable on an interior side of a protective garment while the outer bib portion is positionable over an exterior side of the protective garment to prevent objects from entering the protective garment.

18 Claims, 1 Drawing Sheet

FIREFIGHTING HOOD WITH DUAL BIB

CROSS REFERENCE TO RELATED APPLICATIONS

This application claims the benefit of U.S. Provisional Application Ser. No. 60/313,254, filed Aug. 17, 2001.

BACKGROUND OF THE INVENTION

1. Field of the Invention

The present invention relates generally to a protective hood for a firefighter, and more particularly, but not by limitation, to a firefighting hood with an inner bib portion and an outer bib portion.

2. Brief Description of Related Art

To protect the head, face, and neck areas, a firefighter often wears a firefighting hood in conjunction with other protective equipment such as a protective coat, a face mask, and a helmet. Firefighting hoods are often provided with a bib portion that extends over the shoulders and torso region of the firefighter. Firefighting hoods are constructed of a fire-retardant, thermal barrier material, such as a knitted or woven aramid polymer material. Typically, firefighting hoods are made of two or more layers of such material. This layered arrangement of material protects the firefighter from burns of the skin.

A firefighter will generally be wearing his firefighting coat upon arrival at a scene of a fire. After assessing the scene, the firefighter may don the firefighting hood. This involves tucking the bib of the hood inside the collar of the overcoat. The problem experienced with this arrangement is that firefighting hoods have a tendency to gather around the neck of the firefighter. Thus, a funnel is created between the bib and the collar of the firefighting coat which creates a point of entry into the coat for heat, embers, water and other debris, and thus leave the firefighter susceptible to burns.

Accordingly, a need exists for firefighting hood that sufficiently covers the exposed areas of a firefighter and which prevents heat, embers, water, and other debris from coming into contact with the firefighter. It is to such a firefighting hood that the present invention is directed.

DETAILED DESCRIPTION OF THE INVENTION

Figure 1:
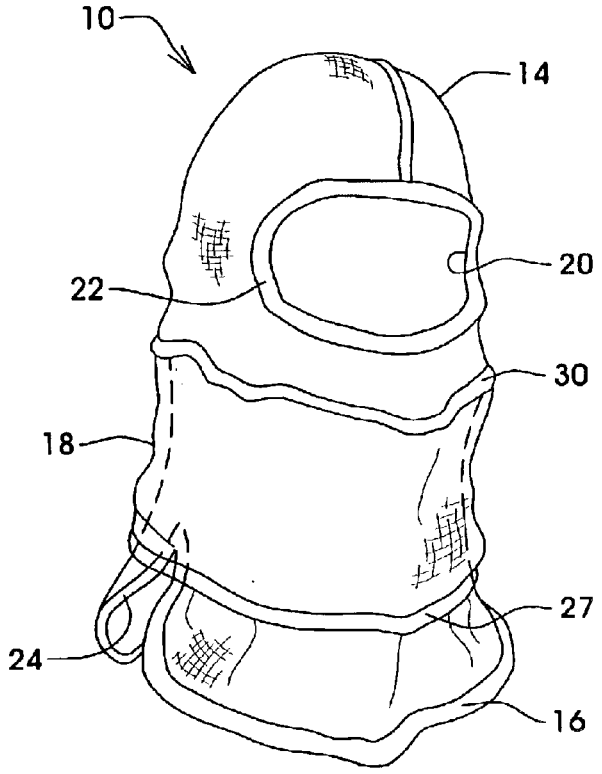
FIG. 1 is a partially cut-away, perspective view of a firefighting hood constructed in accordance with the present invention.
Figure 2:
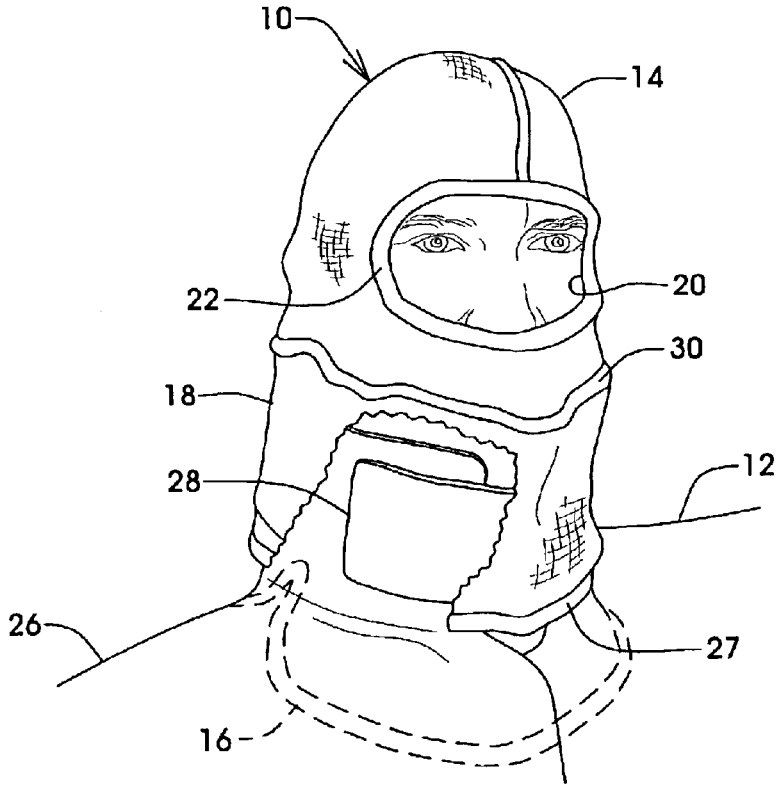
FIG. 2 is a partially cut-away, perspective view of the firefighting hood of FIG. 1 shown donned on a firefighter.

Referred now to FIGS. 1 and 2, a firefighting hood 10 constructed in accordance with the present invention is shown in FIG. 1, while the firefighting hood 10 is shown donned on an individual 12 in FIG. 2. The firefighting hood 10 includes a head portion 14, an inner bib portion 16, and an outer bib portion 18.

The head portion 14 is shaped to cover the head of the individual 12 and includes a face opening 20 for exposing at least a portion of the individual's face. The face opening 20 is defined by an annular edge 22 which may include an elastic material so as to cause the head portion 12 to fit snugly around the individual's face.

The inner bib portion 24 extends downwardly from the head portion 14 and is preferably shaped to cover the individual's neck and a portion of the individual's torso. To this end, the inner bib portion 16 is provided with a pair of side notches 24 to allow the inner bib portion 16 to fit over the shoulders of the individual and lay against the neck and torso of the individual so that an outer protective garment 26 shown in FIG. 2 may be worn by the individual 12 with the inner bib portion 16 positioned on an interior side of the outer protective garment 26.

The outer bib portion 18 extends downwardly from the head portion 14 and overlaps an exterior side of the inner bib portion 16 such that the inner bib portion 16 is positionable on the interior side of the outer protective garment 26 while the outer bib portion 18 is positionable over an exterior side of the outer protective garment 26 to prevent objects from entering the outer protective garment 26. When donning the firefighting hood 10, the outer bib portion 18 can be rolled up away from the inner bib portion 16 so as to be out of the way while the inner bib portion 14 is positioned on the interior side of the protective garment 26.

In FIG. 2, the outer protective garment 26 is shown to be a firefighting coat with a collar 28 designed to extend around the neck of the individual 12. With a protective garment of this type, the inner bib portion 16 is positioned on the interior side of the collar 28 of the firefighting coat while the outer bib portion 18 is positioned over the collar 28 of the firefighting coat. By being positioned over the collar 28, the outer bib portion 18 covers the opening between the inner bib portion 16 and the upper end of the collar 28, thereby preventing objects such as embers, water, and other debris from entering the firefighting coat via the collar 28. To cause the outer bib portion 18 to be held against the collar 28 of the firefighting coat, the outer bib portion 18 has a lower edge 27 provided with an elastic material.

The head portion 14, the inner bib portion 16, and the outer bib portion 18 are each preferably constructed of inner and outer layers of a flame and heat resistant material, although any number, or combination, of layers of a flame and heat resistant material can be used. For example, the head portion 14 and the outer bib portion 18 may each be fabricated of two layers of material, while the inner bib portion 16 is fabricated of only one layer of material. Examples of heat and flame resistant knitted or woven materials for use with the present invention include an aramid polymer material, such as NOMEX®, a polybenzamidazole ("PBI") fiber, an aramid fiber such as KEVIAR®, or a combination or blend of these or similar materials. In addition, the head portion 14, the inner bib portion 16 and the outer bib portion 18 may be modified to include additional layers to provide chemical, radiological, or fluid-born biological protection.

The head portion 14, the inner bib portion 16, and the outer bib portion 18, are shown in FIGS. 1 and 2 as being constructed as separate pieces and attached at a juncture 30 in a suitable fashion, such as by sewing. It will be appreciated by those of ordinary skill in the art that while the head portion 14, the inner bib portion 16, and the outer bib portion 18 have been described and shown as being constructed as separate pieces, the head portion 14 and the inner bib portion 16 may be constructed as a single piece with the outer bib portion 18 being constructed as a separate piece which is in turn attached to the head portion 14 and the inner bib portion 16. Alternatively, the head portion 14 and the outer bib portion 18 may be constructed as a single piece with the inner bib portion 16 being constructed as a separate piece and attached to the head portion 14 and the outer bib portion 18. Still yet, the head portion 14, the inner bib portion 16, and the outer bib portion 18 may be constructed as a single piece with the head portion 14 being fabricated of an inner layer and an outer layer of material and the inner bib portion 16 defined by the inner layer of material which is separated from the outer layer and the outer bib portion 18 defined by the outer layer of material.

It will further be understood by those of ordinary skill in the art that the position of the juncture 30 may be altered depending on the configuration of the protective garment with which the firefighting hood 10 is to be used. For example, as shown in FIG. 2, the collar 28 of the outer protective garment 26 is designed to extend near the chin of the individual 12. To this end, the juncture 30 of the inner bib portion 16 and the outer bib portion 18 should be positioned near the chin of the individual when donned so that the collar 28 may be positioned between the inner bib portion 16 and the outer bib portion 18. However, the juncture 30 may be positioned lower if the protective garment is not provided with a collar. In which case, firefighting hood 10 can be formed so that the juncture 30 is located near the upper end of the protective garment.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A firefighting hood for protecting an individual from elements associated with a firefighting site, comprising:

a head portion shaped to cover the individual's head and having a face opening for exposing at least a portion of the individual's face, the head portion being fabricated of a fire resistant material;

an inner bib portion extending downwardly from the head portion and shaped to cover the individual's neck and a portion of the individual's torso; and an outer bib portion extending downwardly from the head portion and overlapping the inner bib portion such that the inner bib portion is positionable on an interior side of a protective garment while the outer bib portion is positionable over an exterior side of the protective garment to prevent objects from entering the protective garment, the outer bib portion being fabricated of a fire resistant material.

2. The firefighting hood of claim 1 wherein the inner bib portion is fabricated of a fire resistant material.

3. The firefighting hood of claim 1 wherein the outer bib portion has a lower edge provided with an elastic material.

4. A firefighting hood in combination with a firefighting coat, the firefighting coat having a collar, the firefighting hood comprising:

a head portion shaped and positioned so as to cover the individual's head, the head portion having a face opening positioned so as to expose at least a portion of the individual's face, the head portion being fabricated of a fire resistant material;

an inner bib portion extending downwardly from the head portion, the inner bib portion positioned on an interior side of the collar of the firefighting coat so as to cover the individual's neck and a portion of the individual's torso; and an outer bib portion extending downwardly from the head portion and positioned on an exterior side of the collar of the firefighting coat so as to extend over an upper end of the collar to prevent objects from entering the firefighting coat via the collar of the firefighting coat, the outer bib portion being fabricated of a fire resistant material.

5. The combination of claim 4 wherein the inner bib portion is fabricated of a fire resistant material.

6. The combination of claim 4 wherein the outer bib portion has a lower edge provided with an elastic material to hold the outer bid portion against the collar of the firefighting coat.

7. A method for protecting an individual wearing a firefighting coat from elements associated with a firefighting site, the firefighting coat having a collar, the method comprising:

providing a firefighting hood, comprising:

a head portion shaped to cover the individual's head and having a face opening for exposing at least a portion of the individual's face, the head portion being fabricated of a fire resistant material;

an inner bib portion extending downwardly from the head portion and shaped to cover the individual's neck and a portion of the individual's torso, the inner bib portion being fabricated of a fire resistant material; and an outer bib portion extending downwardly from the head portion and overtapping the inner bib portion, the outer bib portion being fabricated of a fire resistant material;

positioning the head portion on the individual's head;

positioning the inner bib portion on an interior side of the collar of the firefighting coat so as to cover the individual's neck and a portion of the individual's torso; and positioning the outer bib portion over at least an upper end of the collar to prevent objects from entering the firefighting coat via the collar of the firefighting coat.

8. A method for protecting an individual wearing a protective firefighting garment from elements associated with a firefighting site, the method comprising:

providing a firefighting hood fabricated of a fire resistant material and comprising:

a head portion shaped to cover the individual's head and having a face opening for exposing at least a portion of the individual's face, the head portion being fabricated of a fire resistant material;

an inner bib portion extending downwardly from the head portion and shaped to cover the individual's neck and a portion of the individual's torso; and an outer bib portion extending downwardly from the head portion and overlapping the inner bib portion, the outer bib portion being fabricated of a fire resistant material;

positioning the head portion on the individual's head;

positioning the inner bib portion on an interior side of the firefighting garment so as to cover the individual's neck and a portion of the individual's torso; and positioning the outer bib portion over at least an upper end of the firefighting garment to prevent objects from entering the firefighting garment via the upper end of the firefighting garment.

9. The method of claim 8 wherein the inner bib portion is fabricated of a fire resistant material.

10. A firefighting hood for protecting an individual from elements associated with a firefighting site, comprising:

a head portion shaped to cover the individual's head and having a face opening for exposing at least a portion of the individual's face, the head portion being fabricated of a fire resistant material;

an inner bib portion extending downwardly from the head portion and shaped to cover the individual's, neck; and an outer bib portion extending downwardly from the head portion and overlapping the inner bib portion such that the inner bib portion is positionable on an interior side of a protective garment while the outer bib portion is positionable over an exterior side of the protective garment to prevent objects from entering the protective garment, the outer bib portion being fabricated of a fire resistant material.

11. The firefighting hood of claim 10 wherein the inner bib portion is fabricated of a fire resistant material.

12. The firefighting hood of claim 10 wherein the outer bib portion has a lower edge provided with an elastic material.

13. A firefighting hood in combination with a firefighting coat, the firefighting coat having a collar, the firefighting hood comprising:

a head portion shaped and positioned so as to cover the individual's head, the head portion having a face opening positioned so as to expose at least a portion of the individual's face, the head portion being fabricated of a fire resistant material;

an inner bib portion extending downwardly from the head portion, the inner bib portion positioned on an interior side of the collar of the firefighting coat so as to cover the individual's neck; and an outer bib portion extending downwardly from the head portion and positioned on an exterior side of the collar of the firefighting coat so as to extend over an upper end of the collar to prevent objects from entering the firefighting coat via the collar of the firefighting coat, the outer bib portion being fabricated of a fire resistant material.

14. The combination of claim 13 wherein the innerbib portion is fabricated of a fire resistant material.

15. The combination of claim 13 wherein the outer bib portion has a lower edge provided with an elastic material to hold the outer bid portion against the collar of the firefighting coat.

16. A method for protecting an individual wearing a firefighting coat from elements associated with a firefighting site, the firefighting coat having a collar, the method comprising:

providing a firefighting hood, comprising:

a head portion shaped to cover the individual's head and having a face opening for exposing at least a portion of the individual's face, the head portion being fabricated of a fire resistant material;

an inner bib portion extending downwardly from the head portion and shaped to cover the individual's neck, the inner bib portion being fabricated of a fire resistant material; and an outer bib portion extending downwardly from the head portion and overlapping the inner bib portion, the outer bib portion being fabricated of a fire resistant material;

positioning the head portion on the individual's head;

positioning the inner bib portion on an interior side of the collar of the firefighting coat so as to cover the individual's neck; and positioning the outer bib portion over at least an upper end of the collar to prevent objects from entering the firefighting coat via the collar of the firefighting coat.

17. A method for protecting an individual wearing a protective firefighting garment from elements associated with a firefighting site, the method comprising:

providing a firefighting hood fabricated of a fire resistant material and comprising:

a head portion shaped to cover the individual's head and having a face opening for exposing at least a portion of the individual's face, the head portion being fabricated of a fire resistant material;

an inner bib portion extending downwardly from the head portion and shaped to cover the individual's neck; and an outer bib portion extending downwardly from the head portion and overlapping the inner bib portion, the outer bib portion being fabricated of a fire resistant material;

positioning the head portion on the individual's head;

positioning the inner bib portion on an interior side of the firefighting garment so as to cover the individual's neck; and positioning the outer bib portion over at least an upper end of the firefighting garment to prevent objects from entering the firefighting garment via the upper end of the firefighting garment.

18. The method of claim 17 wherein the inner bib portion is fabricated of a fire resistant material.

* * * * *